United States Patent [19]

Laing et al.

[11] 4,258,258

[45] Mar. 24, 1981

[54] CORONA WIRE MOUNTING DEVICE

[75] Inventors: Jean W. Laing; Fred F. Hubble, III, both of Rochester, N.Y.

[73] Assignee: Xerox Corporation, Stamford, Conn.

[21] Appl. No.: 79,758

[22] Filed: Sep. 28, 1979

[51] Int. Cl.[3] ..... H01T 19/04

[52] U.S. Cl. ..... 250/324; 174/152 G

[58] Field of Search ..... 250/324, 325; 174/152 G, 167

[56] References Cited

U.S. PATENT DOCUMENTS

| | | | |
|---|---|---|---|
| 1,206,882 | 12/1916 | Morene | 174/152 G |
| 1,944,138 | 1/1934 | King | 174/167 |
| 3,244,083 | 4/1966 | Gundlach | 250/324 |
| 4,071,688 | 1/1978 | Lynch et al. | 174/167 |
| 4,118,751 | 10/1978 | Hubble et al. | 250/324 |

*Primary Examiner*—Harold A. Dixon

[57] ABSTRACT

A corona generating device having a corona electrode supported between a pair of endblock assemblies, each endblock assembly defining a space for the passage of the electrode, and non-conductive inserts seated in the spaces in the endblock assemblies and surrounding the electrode. The non-conductive inserts are made of a material with high dielectric strength and resistent to corrosive atmosphere. The inserts can be easily and inexpensively replaced and they protect the endblock assemblies from effects of applying high voltages to the corona electrode.

9 Claims, 6 Drawing Figures

CORONA WIRE MOUNTING DEVICE

BACKGROUND OF THE INVENTION AND PRIOR ART STATEMENT

This invention relates to corona generating devices for applying electrostatic charge onto a suitable surface. More particularly, this invention relates to a novel corona generating device for use in electrostatography, in which the voltage applied to the corona generating devices is relatively high.

In the electrostatographic process, an electrostatographic plate comprising a photoconductive insulating material on a conductive backing is given a uniform electric charge over its surface and is then exposed to the subject matter to be reproduced, usually by conventional projection techniques. This exposure discharges the plate areas in accordance with the radiation intensity which reaches them and thereby creates an electrostatic latent image on or in the plate coating which may then be developed into a visible form by applying a developer material to the plate using any one of a number of development techniques generally known and used in the art. The developer material electrostatically clings to the plate in a visual pattern corresponding to the electrostatic image. Thereafter, the developed image is usually transferred from the plate to a support material, such as paper, to which it may be fixed by any suitable means thereby forming a permanent print.

The charging of the electrostatographic plate in preparation for the exposure step is accomplished by means of a corona generating device whereby an electrostatic charge is applied to the electrostatographic plate to raise it to a positive or negative potential in the range of approximately 600 to 1,000 volts. Examples of corona generating devices for this purpose are disclosed in U.S. Pat. Nos. 2,777,957 and 2,836,725. In U.S. Pat. No. 2,777,957, a plurality of parallel wires are connected to a high voltage source and supported in a conductive shield that is arranged in closely spaced relation to the surface to be charged. When the wires are energized with suitable high voltage, corona is generated along the surface of the wires and ions are caused to be deposited on the adjacent photoconductive surface. Suitable means are usually provided to effect relative movement between the surface to be charged and the corona generating device. Such a device may alternatively have a single corona wire, as shown in U.S. Pat. No. 2,836,725.

As indicated in U.S. Pat. No. 4,110,614, the conventional form of corona discharging device for use in reproduction systems generally involves the connection of a conductive corona electrode in the form of an elongated wire to a corona generating high voltage source. As indicated in that patent, several problems have been found with such corona devices. These problems include inability to deposit a relatively uniform charge, the growth of chemical compounds on the coronode which eventually degrades the operation of the corona device, and the degradation in charging output resulting from contamination of the coronode by toner particles, etc. In said U.S. Pat. No. 4,110,614, there is disclosed a corona charging device which employs a corona discharge electrode which comprises a wire coated with a relatively thick layer of dielectric material, such as a glass coating. The generation of ions is accomplished by means of an AC electric field established at the dielectric surface by capacitive coupling through the dielectric material. The flow of ions to the surface to be charged is regulated by means of a bias applied to a conductive biasing member which establishes an electric field between the surface to be charged and the member. Such a dielectric coated corona device generally requires the use of higher coronode voltages for the generation of charge, for example, 8,000 to 10,000 volts peak or higher.

The use of such higher voltages, together with the presence of a conductive biasing member, have caused problems in the degradation of the endblocks or the mounting means for the corona discharge electrode or wire. This degradation may be appreciated from the fact that the corona discharge electrode is at a high electric potential and there is a large difference in potential between the corona discharge electrode and the surrounding structures. The high voltage on the corona discharge electrode can lead to streaming or arcing and a corona around the electrode in the endblock region. Streaming is sometimes seen as a glow-like discharge. Arcing may be seen as sparks and the corona region is the result of partial ionization of the air surrounding the electrode. Electric arcs will, of course, attack the materials with which the arcs are in contact. The corona region contains ions or charged particles, and such charged particles will attack the endblocks or other structures which support or mount the electrode. The large potential difference between the corona discharge electrode and the biasing member, and between the corona discharge electrode and the mounting means for the electrode, may cause electrical discharges within the endblocks. Although the precise scientific explanation for such electrical discharges are not known, it is believed that minute voids in the endblock materials permit the electrical discharges and corona to take place within the voids. The discharges carbonize and enlarge the voids, which leads to bigger discharges, which leads to bigger voids, ultimately resulting in the complete failure of the endblocks. This process is sometimes referred to as a channeling mechanism.

Other factors contributing to the erosion of the endblock structure include the presence of ozone and other chemicals in the atmosphere near a corona generating device.

Prior art endblocks were generally constructed of highly dielectric plastic materials such as nylon or polyvinylchloride. See, e.g., U.S. Pat. Nos. 4,110,811 and 4,112,298. Although such plastic materials are strongly dielectric, they cannot prevent or withstand arcing or sparking upon prolonged exposure to high voltages, particularly such high voltages used with a dielectrically coated coronode. Accordingly, there is a need for improved endblocks or mounting means for corona electrodes.

OBJECTS AND SUMMARY OF THE INVENTION

It is an object of the invention to provide an improved construction of corona generating devices.

It is another object of the invention to provide improved corona electrode mounting means which are longer lasting and which can be used with high applied voltages on the corona electrode.

It is a further object of the invention to provide an improved corona wire mounting means which is economical to make and easy and inexpensive to replace.

These and other objects of the invention will be apparent from the following disclosure.

In accordance with this invention, a corona generating device is provided in which a corona generating wire is supported between composite insulating endblocks. The composite insulating endblocks are made of two parts: the body of the endblocks are made of high dielectric strength and chemically resistant plastic materials which can be easily molded into intricate shapes; and an insert for each endblock which substantially envelopes the corona emitting wire in the region of the endblocks, and which is seated in a cavity formed in the endblock for the passage of the corona electrode through the endblock. The insert is made of a ceramic, a glass, or a relatively expensive and difficulty moldable but high dielectric strength plastic material.

BRIEF DESCRIPTION OF THE DRAWINGS

In the accompanying drawings:

Referring to FIG. 1, there is shown a corona generating device 10 having a body portion 12 and endblocks 14 and 16. In endblock 14 there is an insert 18 and in endblock 16 there is an insert 20. The body portion 12 has parallel walls 22 and 24 which are spaced apart and connected by floor 26. The top of the body portion is open. A biasing electrode 28 is disposed parallel to the floor 26. A tab 34 is provided to facilitate the handling of the corona generating device. A corona electrode 30 having a bead 32 at one end is mounted in the inserts.

In FIG. 2, the end of the corona generating device containing end block 14 and insert 18 is shown in an elevational view. As more clearly seen here, the biasing electrode 28 is in the shape of an I-beam, with a top plate portion 94 and bottom plate portion 36 connected by a rib portion 38. The biasing electrode 28 is made of an electrically conductive material such as stainless steel or aluminum, and it is electrically connected to a terminal 40 through a spring clip 42. Electrical terminal 40 is protected by an insulating housing 44. Spring clip 42 serves the dual function of insuring electrical connection between biasing electrode 28 and the terminal 40 as well as to push the biasing electrode 28 against the flat locating surface 46 in the endblock 14. The corona electrode 30 is shown as passing out of insert 18 towards a means (not shown) for securing it in a taut condition.

In FIG. 3, that end of the corona generating device 10 containing endblock 16 and insert 20 is shown in an elevational view. The tab 34 is shown attached to the end portion 48 of the biasing electrode 28 through a pin 50 seated in a hole 52. A spring clip 54 is provided to keep the biasing electrode 28 flush against flat locating surface 56 in the endblock 16. The bead 32 at one end of the corona electrode 30 is shown as abutting the opening 78 (see FIG. 5) of insert 20 to help keep the corona electrode in a taut condition.

Inserts 18 and 20 are shown in detail in the perspective views in FIGS. 4 and 5, respectively. In FIG. 4, the insert 18 is shown to have collars 58 and 60 at the ends of a central tubular section 62. When the tubular section 62 is seated in a cavity 64 (see FIG. 1) in the endblock 14, collars 58 and 60 cooperate to retain the insert in the endblock against any force which causes the insert to be pulled out of the cavity. The external section 66 of insert 18 is made of a cylindrical part 68 and a recessed tubular part 70. The cylindrical part 68 and recessed tubular part 70 defining an angular space therein between 72 for a portion of the length of external section 66.

Figures 4, 5:
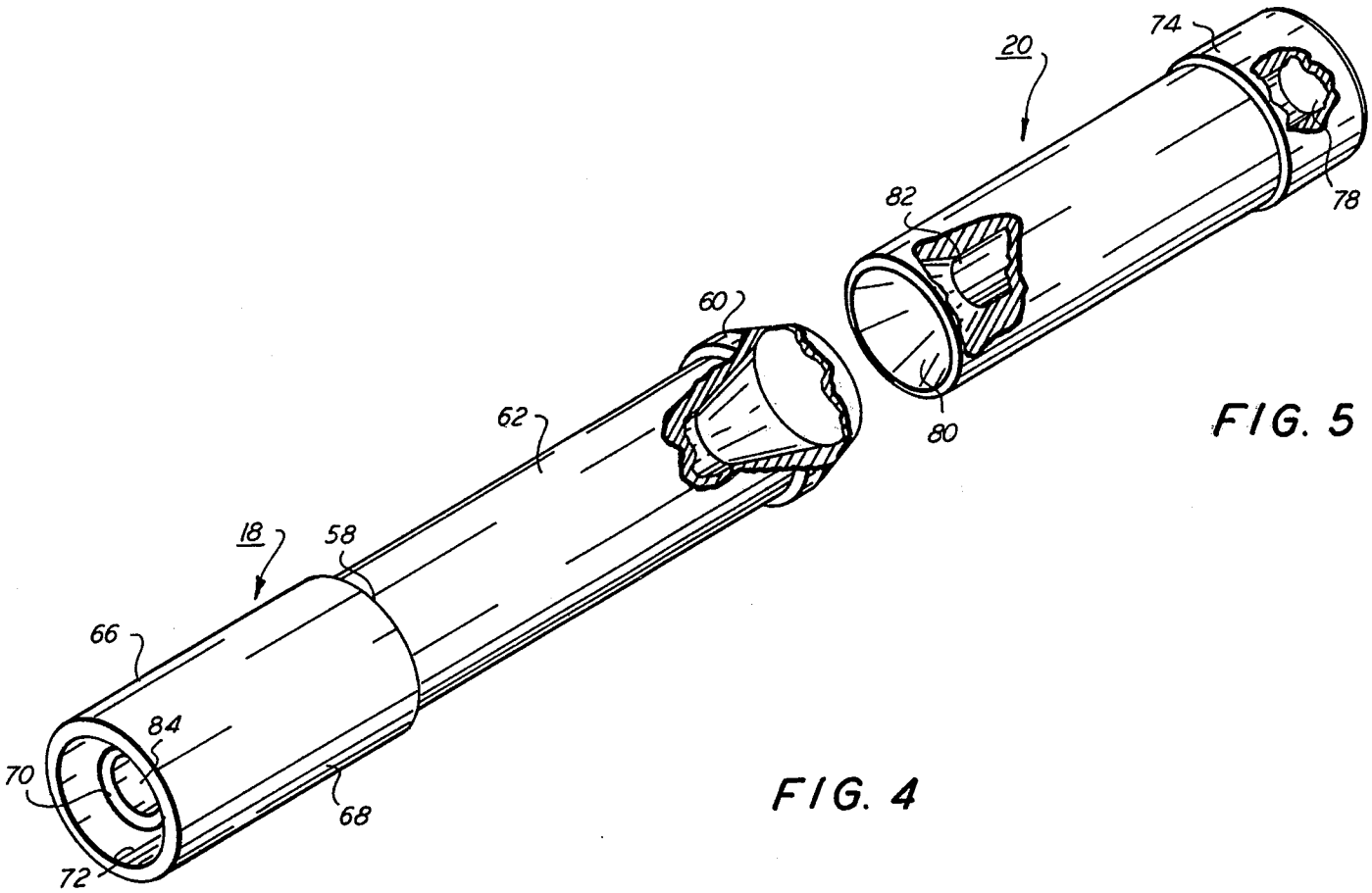
FIG. 4 is a perspective view of one of the inserts to the endblocks in FIG. 1.
FIG. 5 is a perspective view of the insert for the other endblock in FIG. 1.

In the embodiment of the insert shown in FIG. 5, there is only one collar 74. Insert 20 has an opening 78 at one end communicating with a recessed opening 80 at the other end through conduit 82.

Figure 1:
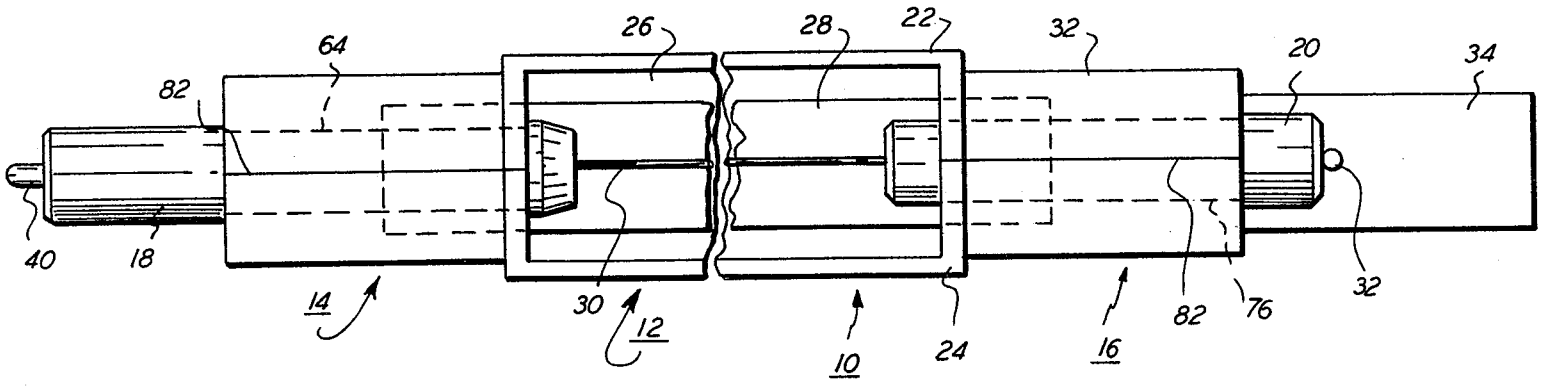
FIG. 1 is a plan view of one embodiment of the corona generating device of the present invention.
Figure 2:
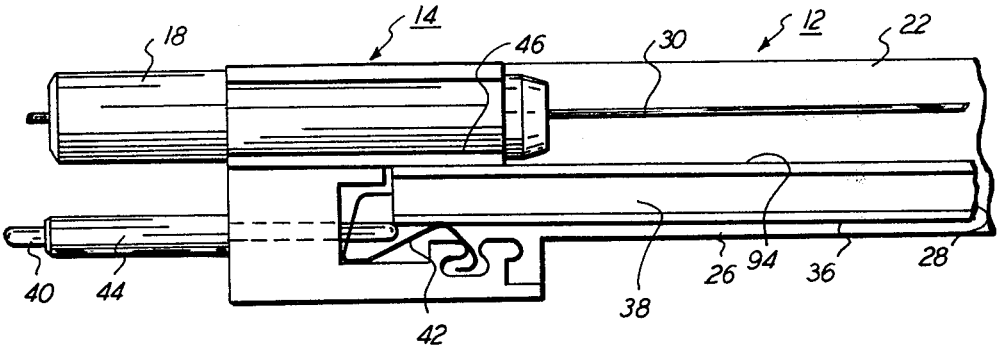
FIG. 2 is an elevational view of one of the endblocks of the device shown in FIG. 1.
Figure 3:
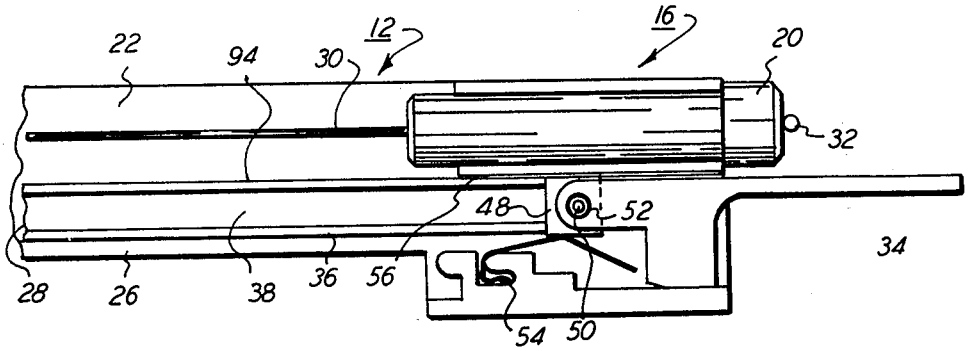
FIG. 3 is an elevational view of the other endblock of the device shown in FIG. 1.

It will be appreciated that although the corona generating device 10 shown in FIG. 1 employs the two different inserts shown in FIGS. 4 and 5, any combinations of these and other inserts within the scope of the present invention may be employed, depending on various engineering and design considerations. In the particular embodiment shown in FIG. 1, the inserts may be removed from the corona generating device 10 and replaced by opening the corona generating device into its two halves along the center line 82 (see FIG. 1). Although the inserts 18 and 20 are shown to be mounted entirely inside endblocks 14 and 16, it will be appreciated that the inserts can be made to rest on the endblocks, for example at the top thereof, and be held in place by spring clips or various snap-on means known to the art. In addition, such snap-on means may form a part of the endblock structure. A corona electrode or coronode, in the form of a corona emitting wire, may be passed through insert 20 by way of conduit 82 towards insert 18. The corona electrode will then pass through insert 18 through conduit 84 and emerge from the recessed tubular part 70. Such a corona electrode may be mounted and held in a taut condition by various means. For example, in the embodiment shown, one end of the corona electrode 30 is provided with a bead, as shown in U.S. Patent 4,110,811, so that the beaded end of the corona electrode may rest or push against the opening 78 of insert 20. Another example for mounting and connecting the corona emitting wire to an electrical terminal is shown in U.S. Pat. No. 4,112,298, in which a corona emitting wire is held in place by means of a conductive connecting screw.

Figure 6:
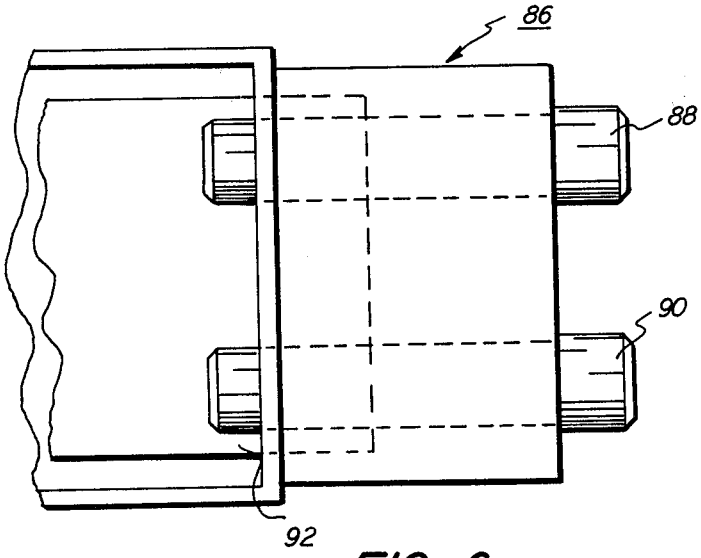
FIG. 6 is a partial plan view of a corona generating device having an endblock with two inserts.

Although the corona generating device 10 shown in FIG. 1 is provided with inserts for only a single corona emitting wire, it will be appreciated that the device of the present invention is applicable to corona generating devices which employ two or more corona wires. FIG. 6 is a schematic illustration of an endblock 86 for a corona generating device using two corona emitting wires. In endblock 86, two inserts 88 and 90, both of which are similar to insert 20 shown in FIG. 5, are provided. A biasing electrode 92 is made of sufficient size to function with respect to both of the corona wires to be housed in inserts 88 and 90.

As indicated above, the high voltages commonly used in corona generating devices, particularly when a dielectric coated corona electrode is employed, tend to cause degradation or erosion of the structural members at or about the endblocks. In accordance with the present invention, an insert is provided in the endblocks to house the electrode and separate it from the rest of the endblocks. The inserts are made of a material with high dielectric strength and resistance to chemical attack, for example from the ozone and acidic atmosphere commonly present around a corona electrode. Since the insert is to house the corona electrode and to protect the remaining parts of the endblock, it may be made generally in the shape of a conduit, without having the intricate shapes and the openings generally associated with endblocks, as shown in the patents mentioned above. Due to the fact that the inserts of the present invention can be made of a very simple shape, they can be molded out of materials which, though have high dielectric strength and strong resistance to chemical attack, are only difficultly moldable and can be formed into complex shapes only by extensive machining with the attendant high costs. Surprisingly, we have found that the inserts of this invention can be simply and inexpensively made, provide substantial protection for the endblocks against the degrading and eroding effect of the high voltages applied to the corona electrode. Examples of the materials which may be used to make the inserts of the present invention include ceramics, glass, and certain high dielectric strength polymers. Specific ceramic materials which can be used to make the inserts of the present invention include a machinable ceramic available from the Corning Glass Works under its trade mark MACOR, and a line of ceramics available from the Western Gold and Platinum Co. under its trade name WEAROX. A suitable high dielectric strength polymer is a polybutylene terephthalate polyesters available from the General Electric Co. under its trade name VALOX. VALOX is believed to be a polybutylene terephthalate polyester reinforced with glass fiber, which enhances many of the properties of the unfilled resin. These and other suitable materials are generally expensive and/or very difficultly moldable or machineable. However, when they are used in making the inserts of the present invention, rather than used in making the entire endblocks for corona generating devices, they are easily moldable and not excessively expensive to use. In addition, a major advantage of the present invention resides in the fact that the inserts are easily and economically replaceable if they become damaged.

While the invention has been described in detail with reference to specific and preferred embodiments, it will be appreciated that various modifications may be made from the specific details without departing from the spirit and scope of the invention.

What is claimed is:

1. A corona generating device for use with high applied voltages which comprises a coronode supported between a pair of endblock assemblies, each endblock assembly defining a space for the passage of said coronode from exterior said assembly to the other endblock assembly, and non-conductive inserts removably mounted in said spaces and surrounding said cornode, said inserts being made of a material with high dielectric strength and resistance to corrosive atmosphere to protect said assemblies from the effects of said high applied voltages, and said inserts being separately replaceable from the remainder of said corona generating device when said inserts have been eroded by the effects of said high applied voltages.

2. A corona generating device of claim 1 wherein said inserts being constructed to substantially fill said spaces.

3. A corona generating device of claim 1 wherein said inserts having only substantially unidirectional passageways.

4. A corona generating device of claim 3 wherein said inserts are substantially tubular in shape.

5. A corona generating device of claim 3 wherein said inserts are molded of a ceramic, a glass, or a high dielectric strength polymer.

6. A corona generating device of claim 4 wherein said inserts are molded of a ceramic.

7. A corona generating device of claim 4 wherein said inserts are molded of a polybutylene terephthalate polyester.

8. A corona generating device of claim 1 wherein said spaces are located within said endblock assemblies.

9. A corona generating device of claim 1 wherein said spaces are located adjacent an exterior surface of said endblock assemblies and wherein said inserts are mounted in said spaces by snap-on means.

* * * * *